US006957599B2

(12) United States Patent
Corredor et al.

(10) Patent No.: US 6,957,599 B2
(45) Date of Patent: Oct. 25, 2005

(54) BEVERAGE BOTTLE AND CAN OPENER

(76) Inventors: Pablo E. Corredor, 1585 E. 11th Ave., Hialeah, FL (US) 33010; Alejandro Stefanini, 1585 E. 11th Ave., Hialeah, FL (US) 33010

( * ) Notice: Subject to any disclaimer, the term of this patent is extended or adjusted under 35 U.S.C. 154(b) by 0 days.

(21) Appl. No.: 10/694,231

(22) Filed: Oct. 28, 2003

(65) Prior Publication Data

US 2005/0183547 A1 Aug. 25, 2005

(51) Int. Cl.[7] ..... B67B 7/44
(52) U.S. Cl. ..... 81/3.09; 81/3.55; 81/3.36; 81/3.45
(58) Field of Search ..... 81/3.09, 3.36, 81/3.29, 3.39, 3.45, 3.47, 3.48, 3.35, 3.55, 81/3.57; D8/33, 34, 38, 40, 42, 43

(56) References Cited

U.S. PATENT DOCUMENTS 1,695,098 A * 12/1928 Hiering ..... 81/3.35
D406,025 S * 2/1999 Hung ..... D8/38
5,911,794 A * 6/1999 Nordhoff ..... 81/3.55
6,098,830 A * 8/2000 Jamieson ..... 81/3.55
6,142,769 A * 11/2000 Walker ..... 81/3.45
D437,538 S * 2/2001 Corredor et al. ..... D8/38
6,212,721 B1 * 4/2001 Borodulin et al. ..... 81/3.09
2001/0027704 A1 * 10/2001 Kee ..... 81/3.48

* cited by examiner

*Primary Examiner*—Debra S Meislin

(57) ABSTRACT

A beverage bottle and can opener apparatus comprising an elongated body with a rear flat and raised bottle-shaped front surfaces, including a first, second and third opener devices. The first opener device having a first cavity with engagement edges for receiving a crimped-top cap of a beverage bottle therein in a force-fit arrangement. The second opener device is housed inside a longitudinal storage recess and includes a rotatable spiral corkscrew member and an elongated lever member both extending longitudinally and perpendicularly from their respective shafts and mounted for axial movement from folded to extending positions for drawing a cork from a beverage bottle. The third opener device includes a second cavity having a rectangular notch being configured to receive a tap-top tab of a beverage can therein. The flat rear surface further has a magnet rigidly mounted thereto to permit the opener apparatus to be held to a metallic surface when it is not in use.

6 Claims, 2 Drawing Sheets

BEVERAGE BOTTLE AND CAN OPENER

BACKGROUND OF THE INVENTION

1. Field of the Invention

The present invention relates to a beverage bottle and can opener, and more particularly to the type, that includes a variety of opening devices in one body.

2. Description of the Related Art

Corkscrews, bottle and can openers of various types have been known for many years and long have been included in multipurpose tools. However, we believe that none of them includes the specific features of the present invention. We disclose a convenient and comfortable piece which includes three types of distinctly different openers and is magnetically held on a metallic surface, such as a refrigerator and the like, when not in use. A user has free access to this three-in-one opener, without the inconvenience of looking around for an opener for a specific type of bottle cap or can. Additionally, the present invention discloses a lever member that aids the user to effortlessly draw a cork from a bottle.

SUMMARY OF THE INVENTION

It is one of the main objects of the present invention to provide a beverage bottle and can opener that includes three distinctly different opening devices in one solid body.

It is another object of this invention to provide a beverage bottle and can opener that is easy to use and manipulate.

It is another object of this invention to provide a beverage bottle and can opener that includes a magnet permitting the opener device to be held to a metallic surface such as a refrigerator or the like.

It is another object of this invention to provide a beverage bottle and can opener that includes an auxiliary lever member that aids the user to effortlessly draw a cork from a bottle.

It is another object of this invention to provide a beverage bottle and can opener that has a raised bottle configuration attached to the front surface of the opener, which may be used for ornamental and/or advertising purposes.

It is still another object of this invention to provide a beverage bottle and can opener that has a spiral corkscrew member including a distal tipped end having a straight configuration to facilitate a user to position the spiral corkscrew member in the axial center of a cork.

It is yet another object of this invention to provide such a device that is inexpensive to manufacture and maintain while retaining its effectiveness.

Further objects of this invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
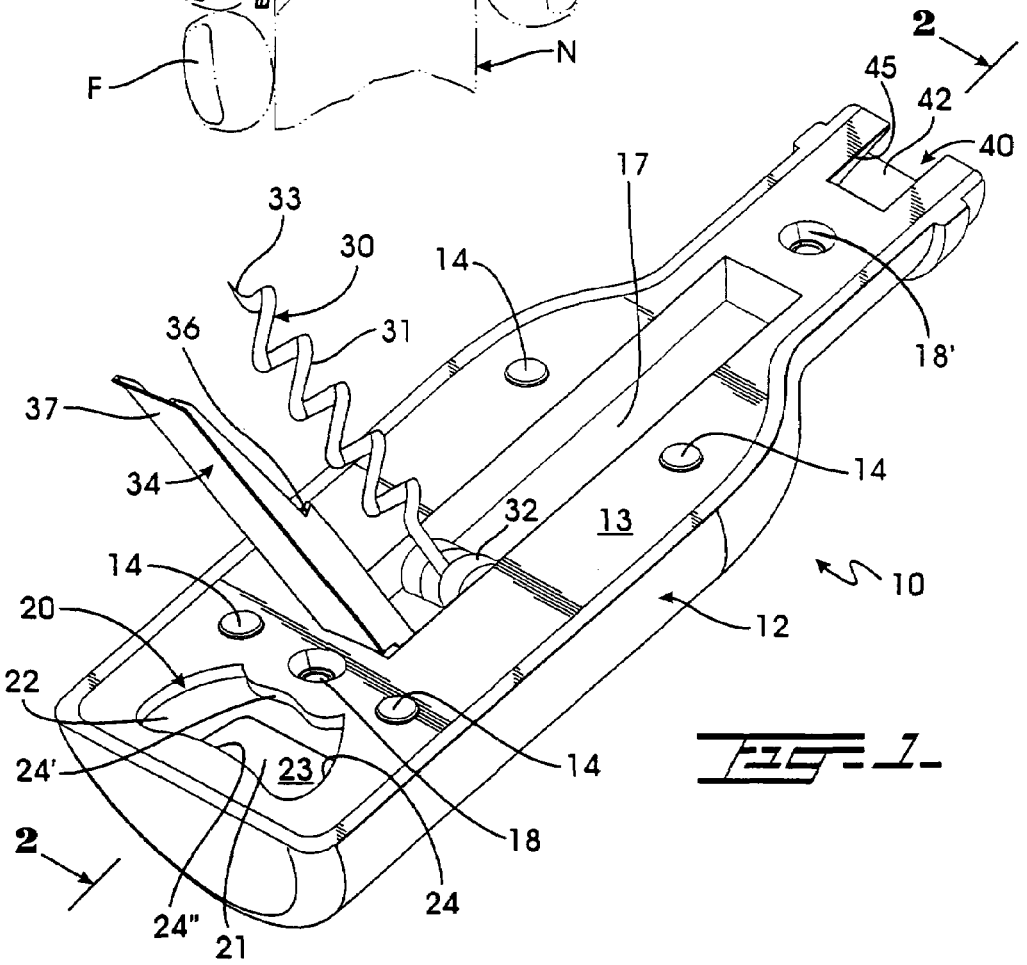
FIG. 1 is an isometric view of the present invention. Both the corkscrew device and the lever member are in fully extended position.
Figure 3:
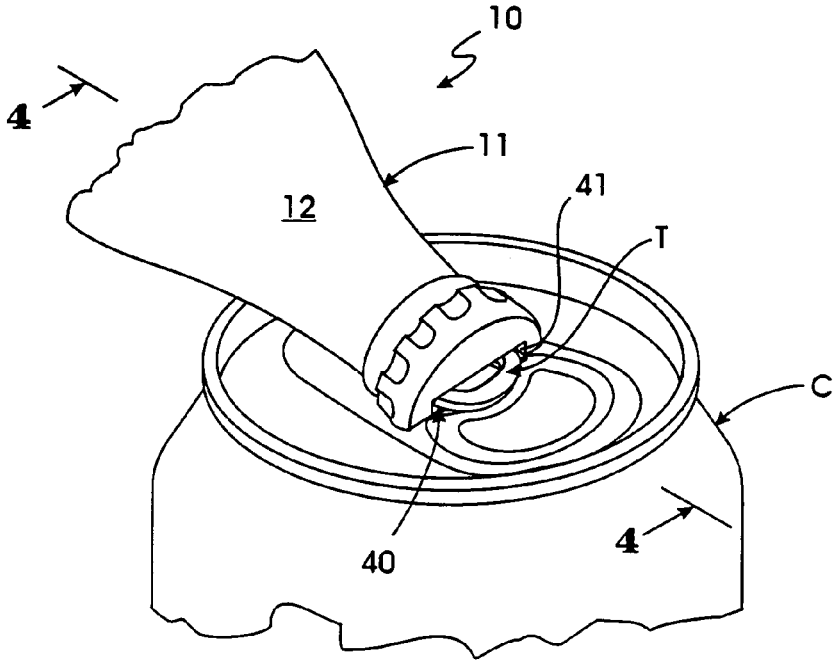
FIG. 3 is a partial isometric view from the front of this invention, illustrating the can opener device engaging tap-top can tab T of can C.

Referring to the drawings in detail and initially to FIG. 1 thereof, it will be seen that beverage bottle and can opener 10 basically includes elongated body 11 having bottle opener device 20, corkscrew device 30 and can opener device 40 therein.

Figure 2:
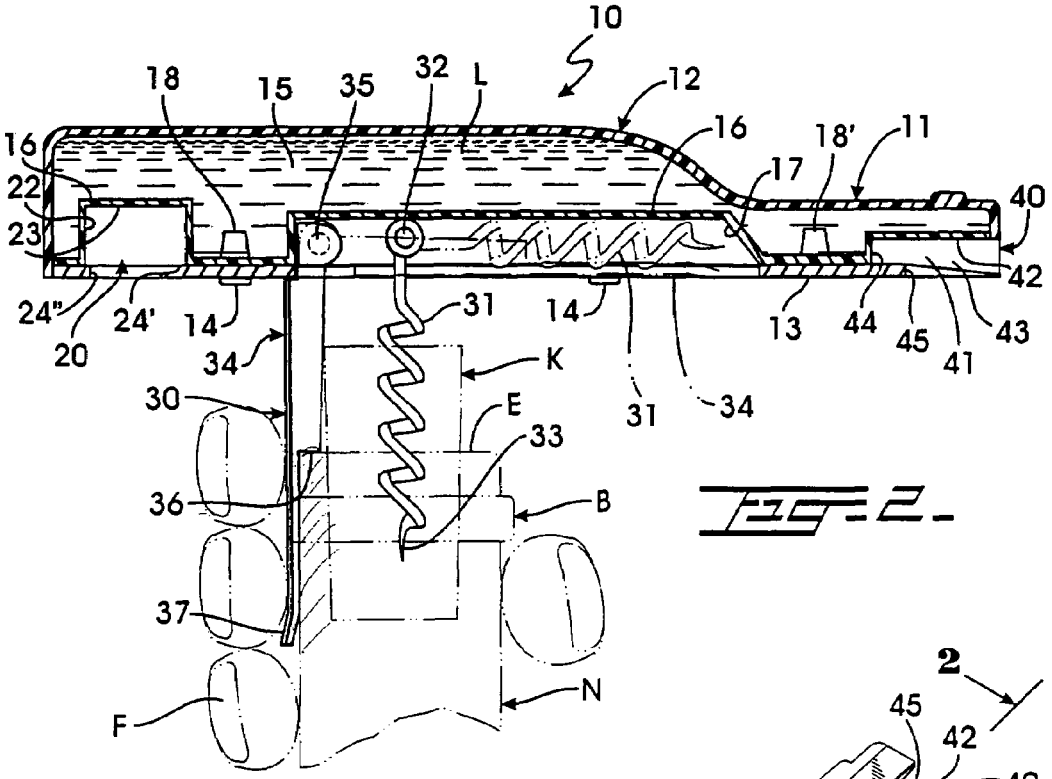
FIG. 2 is an elevational cross sectional view of this invention, taken along line 2—2, illustrating in phantom the corkscrew device and the lever member actuating bottle cork K.

Elongated body 11 includes front surface 12 and rear flat surface 13. In the preferred embodiment, front surface 12 has a raised bottle shape and is intended for decorative and/or advertising purposes, when apparatus 10 is not in use and is held on a refrigerator. Opener 10 has four dot-shaped magnets 14 disposed on rear flat surface 13, which permit the latter to be kept in fully parallel relationship with respect to a planar metallic surface. In the preferred embodiment, body 11 has hermetic chamber 15 peripherally defined by front surface 12 and inner wall 16. Inner wall 16 is firmly mounted to rear flat surface 13 by screw members 18 and 18'. Front surface 12 may be made out of a transparent plastic material so that decorative liquid L contained in hermetic chamber 15 is seen through, thereby imitating a real beverage bottle, as illustrated in FIG. 2.

Opener device 20 is located close to one end of body 11, and more specifically in its bottom section. Opener device 20 includes cavity 21 disposed in flat surface 13 and defined by inner lateral walls 22, bottom wall 23 and upper edge 24, as best seen in FIGS. 1 and 2. Upper edge 24 has arcuate shaped engagement portion 24' inwardly protruding towards opposite curved engagement portion 24". Portion 24' is configured to be placed under the crimped down edge of a bottle cap and levered off, using opposite curved portion 24" as a fulcrum and body 11 as handle and thus as a lever.

Corkscrew device 30 is located at the center of flat surface 13 and inside longitudinal storage recess 17. Corkscrew device 30 basically includes rotatable spiral corkscrew member 31 extending longitudinally and perpendicularly from shaft 32, that in turn is firmly mounted transversally inside longitudinal storage recess 17. Length of longitudinal storage recess 17 is slightly greater than spiral corkscrew member 31 so that a user's finger has free access to actuate distal tipped end 33 in order to pull spiral corkscrew member 31 out of recess 17. Rotatable spiral corkscrew member 31 pivots about shaft 32 thereby axially moving through an angle from folded to extended position, as best seen in FIGS. 1 and 2. In the preferred embodiment, tipped end 33 has a straight configuration to facilitate a user to position corkscrew member 31 in the axial center of cork K. In this manner, the rotation and thus the insertion of spiral corkscrew member 31 inside cork K is guaranteed in its same axial center. Corkscrew device 30 further includes lever member 34 that is disposed also inside longitudinal storage recess 17 extending longitudinally and perpendicularly from shaft 35. Shaft 35 is firmly mounted transversally inside longitudinal storage recess 17. In the preferred embodiment, shaft 35 is disposed is spaced apart and in parallel relationship with respect to shaft 32 of corkscrew member 31. Lever member 34 covers spiral corkscrew member 31 when both are in folded positions inside recess 17. In order to reach and actuate corkscrew member 31, lever member 34 has to be pulled out by supporting end 37 first. Lever member 34 has a longitudinal and semi-rectangular cross-sectional configuration, includes step 36 and elongated supporting end 37. Supporting end 37, in the preferred embodiment, has elongated configuration so that a user's fingers have fully access to hold lever member 34 while actuating and levering opener device 30 to withdraw cork K. Also, this elongated configuration of supporting end 37 and its skirt-like ending prevents lever member 34 from slipping away from bottle neck N. In operation, tipped end 33 of corkscrew member 31 engages cork K of bottle B, rotates as required and step 36 of lever member 34 is cooperatively positioned onto uppermost edge E of bottle B. Then, a user positions his/her fingers F simultaneously around both bottle neck N and lever member 34 to hold bottle B. Finally, a user with the other hand manipulates body 11 by lifting corkscrew member 31, raises and draw cork K from bottle neck N.

Opener device 40 is located at one distal end of flat surface 13, and opposite to opener device 20. Opener device 40 has cavity 41 defined by bottom wall 42, lateral walls 43, rear wall 44 and upper rectangular notch 45. Cavity 41 is sized to conveniently accommodate a protruding tap-top can tab T. Lateral walls 43 prevent can tab T from slipping laterally out from cavity 41 when a user manipulates apparatus 10 to open can C.

Figure 4:
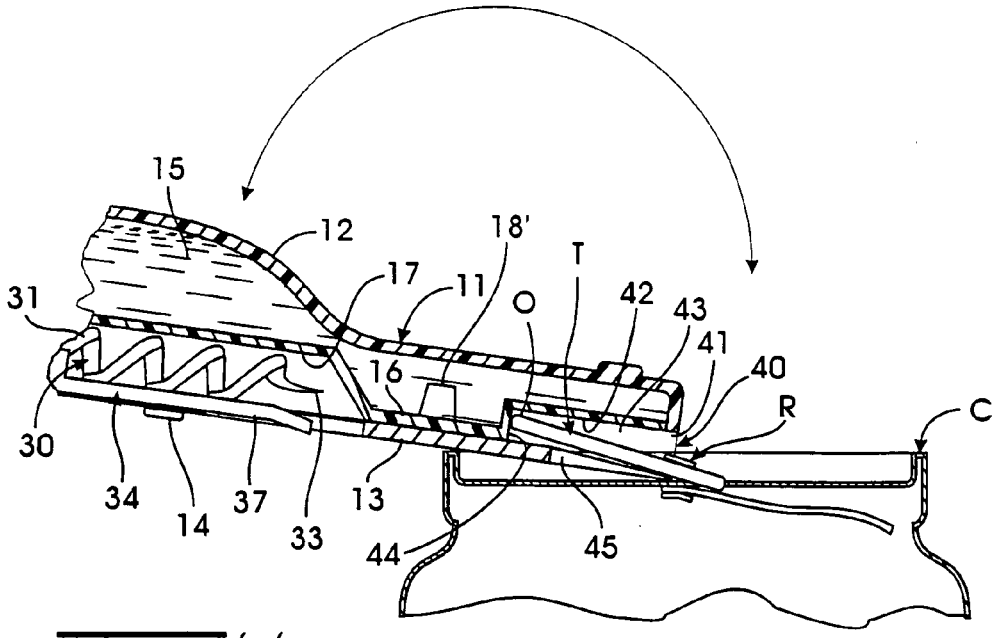
FIG. 4 is a partial cross-sectional elevational view of the can opener device actuating tap-top tab T of can C, taken along line 4—4.

In operation, user handles body 11 having rectangular notch 45 facing down, cavity 41 is slid over tap-top can tab T until outer edge 0 of tap-top can tab T stops against rear wall 44, as best seen in FIG. 4. Depth of bottom wall 42 is enough to cooperatively receive the whole can tab T therein, so that the opening operation is successfully completed without the risk of breaking or bending tab T before opening the can aperture for beverage flow. Generally, European can tabs are made out of a softer metallic material and they were tested, thereby tending to bend if tab T is not substantially housed inside cavity 41. This is possible because notch 45 is configured in such manner that rivet member R of can tab T is not interfering with the displacement of cavity 41 over tab T. Finally, body 11 is used to lever tab T away from can C, thereby opening the can.

The foregoing description conveys the best understanding of the objectives and advantages of the present invention. Different embodiments may be made of the inventive concept of this invention. It is to be understood that all matter disclosed herein is to be interpreted merely as illustrative, and not in limiting sense.

What is claimed is:

1. An opener apparatus for a plurality of different beverage containers, comprising:

an elongated body having a front and rear surfaces, and said rear surface is substantially flat;

a first opener device including a first cavity disposed in said rear surface and close to one end of said elongated body and wherein said first cavity is provided with an upper edge including first and second engagement portions for receiving a crimped-top cap of a beverage bottle therein in a force-fit arrangement;

a second opener device located at the center of said rear surface and housed inside a longitudinal storage recess, said second opener device includes a rotatable spiral corkscrew member extending longitudinally and perpendicularly from a first shaft and mounted for axial movement from folded to extending position for drawing a cork from a beverage bottle, and wherein said rotatable spiral corkscrew member includes a distal tipped end having a straight configuration;

a third opener device located at one distal end of said rear surface and opposite to said first opener device and said third opener device including a second cavity defined by a bottom wall, first and second lateral walls, a rear wall and an upper rectangular notch disposed in said rear surface, and said second cavity being configured to receive a tap-top tab of a beverage can therein; and a magnet means rigidly mounted to said rear surface to permit said elongated body to be held to a metallic surface.

2. The opener apparatus set forth in claim 1 wherein said second opener device further includes an elongated lever member housed inside said longitudinal storage recess, said elongated lever member extends longitudinally and perpendicularly from a second shaft and mounted for axial movement from folded to extending position, and wherein said elongated lever member includes a step to be cooperatively positioned onto the uppermost edge of a bottle and an elongated supporting end to permit a user to hold both said opener apparatus and a bottle neck while levering said opener apparatus to facilitate said spiral corkscrew member to draw a cork from a bottle.

3. The opener apparatus set forth in claim 2 wherein the length of said longitudinal storage recess is slightly greater than said corkscrew member so that a user's finger has free access to actuate said elongated lever member and said corkscrew member.

4. The opener apparatus set forth in claim 1 wherein said front surface has a raised bottle shape and is configured for decorative and advertising purposes.

5. The opener apparatus set forth in claim 4 wherein said elongated body has a chamber hermetically and peripherally defined by said front surface and an inner wall.

6. The opener apparatus set forth in claim 5 wherein said front surface is made out of a transparent material so that a decorative liquid contained in said chamber is seen through, thereby imitating a real beverage bottle.

* * * * *